US009890521B1

(12) United States Patent
Mosley et al.

(10) Patent No.: US 9,890,521 B1
(45) Date of Patent: Feb. 13, 2018

(54) PIT ASSEMBLY WITH REMOVABLE CARTRIDGE

(71) Applicant: Mueller International, LLC, Atlanta, GA (US)

(72) Inventors: Harold Thomas Mosley, Ooltewah, TN (US); Timothy J. Mitchell, Chattanooga, TN (US)

(73) Assignee: Mueller International, LLC, Atlanta, GA (US)

( * ) Notice: Subject to any disclaimer, the term of this patent is extended or adjusted under 35 U.S.C. 154(b) by 11 days.

(21) Appl. No.: 15/218,767

(22) Filed: Jul. 25, 2016

(51) Int. Cl.
*E03B 7/09* (2006.01)

(52) U.S. Cl.
CPC ..... *E03B 7/09* (2013.01); *Y10T 137/6011* (2015.04)

(58) Field of Classification Search
CPC ..... E03B 7/09; Y10T 137/6011
See application file for complete search history.

(56) References Cited

U.S. PATENT DOCUMENTS 7,225,685 B2 * 6/2007 Kawamoto et al. ..... E03B 7/09 73/861.77
8,061,445 B2 * 11/2011 Yater et al. ..... E21B 21/00 175/217
9,238,904 B2 * 1/2016 Mosley et al. ..... E03B 7/072

* cited by examiner

*Primary Examiner* — Kevin Lee
(74) *Attorney, Agent, or Firm* — Taylor English Duma LLP

(57) ABSTRACT

A pit assembly can include a pit liner defining an inner surface and an outer surface, the inner surface defining an interior of the pit liner, the inner surface and the outer surface further defining a pit opening proximate to an upper portion of the pit liner; a pit connector positioned in the interior of the pit liner; a removable cartridge positionable within the interior of the pit liner, the removable cartridge comprising a chassis, a cartridge connector mounted to the chassis and configured to operatively couple in fluid communication to the pit connector, and a piping system in fluid communication with the cartridge connector and mounted to the chassis; and a locking mechanism selectively movable about and between a locked position and an unlocked position.

23 Claims, 8 Drawing Sheets

PIT ASSEMBLY WITH REMOVABLE CARTRIDGE

TECHNICAL FIELD

This disclosure relates to fluid distribution systems. More specifically, this disclosure relates to equipment pit assemblies for purposes such as flushing or metering water distribution systems and piping infrastructures.

BACKGROUND

Pit assemblies may be used to facilitate access to water distribution systems and piping infrastructures, such as for underground water distribution systems and piping infrastructures. The pit assembly can house and protect equipment connected to a piping infrastructure while allowing access to the equipment for maintenance and the removal or installation of equipment. One example of such equipment can be a flushing device which may be used to periodically flush water from a piping infrastructure or water distribution system for reasons including but not limited to preventing stagnation, water age management, freezing prevention, or removal of contaminants.

SUMMARY

Disclosed is a pit assembly comprising a pit liner defining an inner surface and an outer surface, the inner surface defining an interior of the pit liner, the inner surface and the outer surface further defining a pit opening proximate to an upper portion of the pit liner; a pit connector positioned in the interior of the pit liner; a removable cartridge positionable within the interior of the pit liner, the removable cartridge comprising a chassis, a cartridge connector mounted to the chassis and configured to operatively couple in fluid communication to the pit connector, and a piping system in fluid communication with the cartridge connector and mounted to the chassis; and a locking mechanism selectively movable about and between a locked position and an unlocked position, wherein the locked position of the locking mechanism is configured to securely couple the pit connector to the cartridge connector, and wherein the unlocked position of the locking mechanism is configured to release the pit connector from the cartridge connector.

Also disclosed is a removable cartridge configured for installation in a pit comprising a pit inlet connector and a pit outlet connector comprising a chassis; a cartridge inlet connector configured to operatively couple in fluid communication to the pit inlet connector; a cartridge outlet connector configured to operatively couple in fluid communication to the pit outlet connector; an inlet locking mechanism mounted to the cartridge inlet connector and selectively movable about and between a locked position and an unlocked position, the locked position configured to securely couple the cartridge inlet connector to the pit inlet connector, the unlocked position configured to release the cartridge inlet connector from the pit inlet connector; an outlet locking mechanism mounted to the cartridge outlet connector and selectively movable about and between a locked position and an unlocked position, the locked position configured to securely couple the cartridge outlet connector to the pit outlet connector, the unlocked position configured to release the cartridge outlet connector from the pit outlet connector; and a piping system in fluid communication with the cartridge inlet connector and the cartridge outlet connector and mounted to the chassis.

Also disclosed is a method for connecting a piping system in fluid communication to a piping infrastructure, the method comprising inserting a removable cartridge into a pit liner, the pit liner comprising a pit connector positioned in a pit interior defined by an inner surface of the pit liner, the pit connector being in fluid communication with the piping infrastructure, the removable cartridge comprising the piping system, a chassis, and a cartridge connector in fluid communication with the piping system, the piping system and the cartridge connector mounted on the chassis; operably coupling the cartridge connector to the pit connector to place the piping system into fluid communication with the piping infrastructure; and engaging a locking mechanism to secure the pit connector to the cartridge connector.

Also disclosed is a pit assembly comprising a pit liner defining an inner surface and an outer surface, the inner surface defining an interior of the pit liner, the inner surface and the outer surface further defining a pit opening proximate to an upper portion of the pit liner; a pit piping element positioned in the interior of the pit liner; a removable cartridge positionable within the interior of the pit liner, the removable cartridge comprising a chassis and a piping system in fluid communication mounted to the chassis, the piping system comprising an inlet; and a means for operably coupling and locking the pit piping element to the inlet of the piping system of the removable cartridge in fluid communication.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
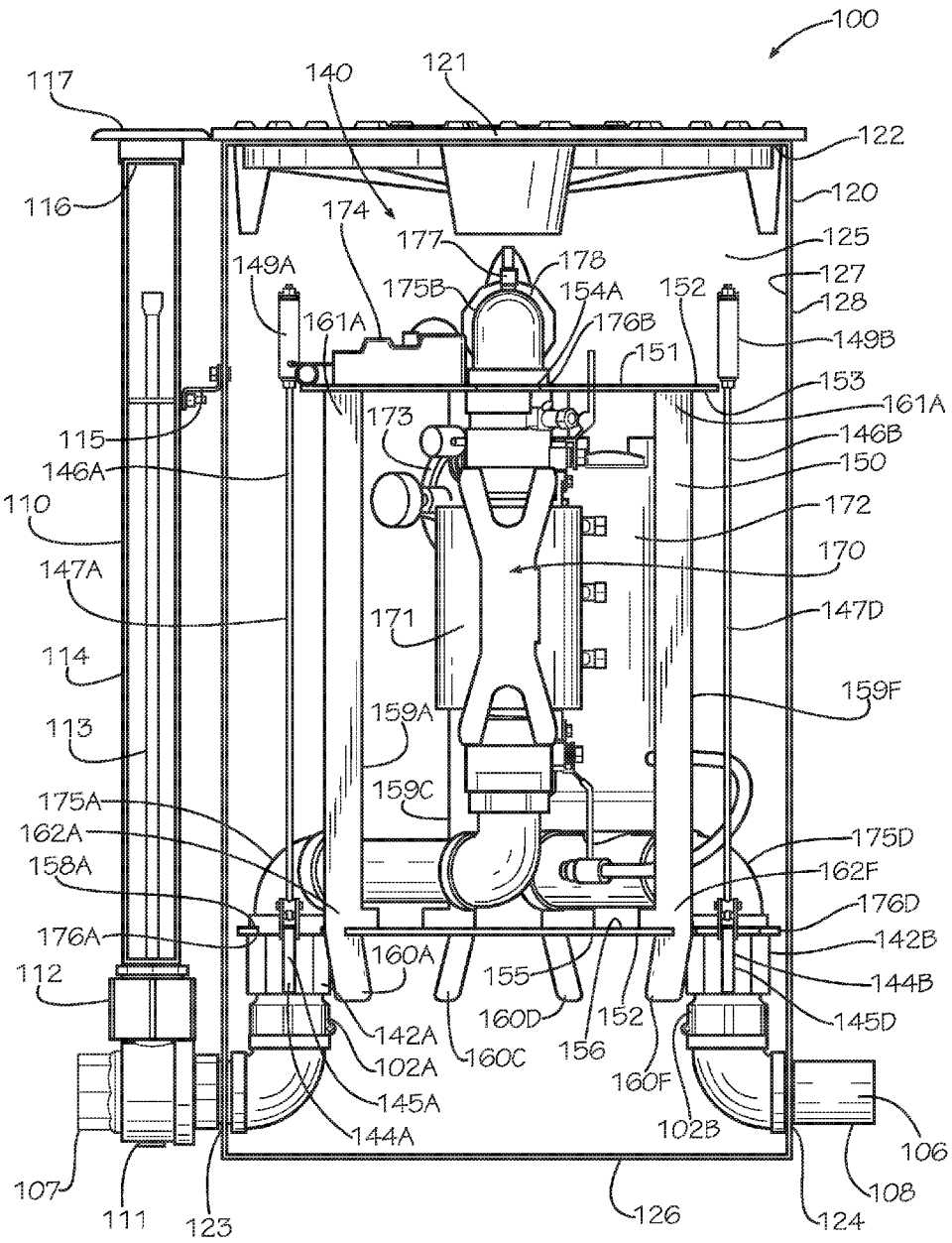
FIG. 1 is a side view of an interior of one aspect of a pit assembly comprising a removable cartridge and a pit liner, with the removable cartridge in an installed position connected to a pit inlet and a pit outlet.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in their best, currently known embodiments. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can comprise two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or Steps are included or are to be performed in any particular embodiment.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

Disclosed is a pit assembly comprising a removable cartridge and associated methods, systems, devices, and various apparatus. The pit assembly comprises a pit liner connectable to a piping infrastructure and a removable cartridge comprising a piping system connectable in fluid communication with the piping infrastructure. It would be understood by one of skill in the art that the pit assembly and removable cartridge are described in but a few exemplary embodiments among many. No particular terminology or description should be considered limiting on the disclosure or the scope of any claims issuing therefrom.

One aspect of a pit assembly 100 comprising a removable cartridge 140 is shown in FIG. 1 in which the removable cartridge 140 is configured as a flushing device. The pit assembly 100 can comprise a pit liner 120, a lid 121, a pit inlet connector 102A in fluid communication with a distribution side 107 of a piping infrastructure 106, a curb stop assembly 110 in fluid communication with the distribution side 107, and a pit outlet connector 102B in fluid communication with a discharge side 108 of the piping infrastructure 106. The piping infrastructure system can be any fluid-carrying system including but not limited to a water supply system, a natural gas system, a sewage system, or an irrigation network.

The pit liner 120 defines an inner surface 127 and an outer surface 128 which together define a pit interior 125, a pit opening 122, and a pit bottom 126. The pit liner 120 can be cylindrical in shape, but in some aspects, the pit liner can comprise a different shape, such as a square or rectangular cross-sectional shape. The pit liner 120 defines a center axis that can be substantially parallel to a vertical direction. The pit opening 122 defines a plane that can be substantially parallel to a horizontal plane and normal to the vertical center axis of the pit liner 120. A removable lid 121 sits atop the pit liner 120 and seals the pit opening 122. In some aspects, the lid 121 can be lockable to prevent tampering or theft of the removable cartridge 140. The pit liner 120 can be installed in the earth below-grade with the pit opening 122 and the lid 121 approximately flush with the surface grade. In some aspects, the pit liner 120 and removable cartridge 140 can be installed above-ground or only partially buried. In various aspects, the pit bottom 126 can be open to the ground, sealed off from the ground, or semi-permeable such that liquids can drain from the pit liner but solids such as dirt cannot enter the pit liner 120 through the pit bottom.

The pit inlet connector 102A can be positioned within the pit interior 125 such that the distribution side 107 of the piping infrastructure 106 penetrates the pit liner 120 through an inlet conduit 123 defined between the inner surface 127 and the outer surface 128 of the pit liner 120. The pit outlet connector 102B can be positioned within the pit interior 125 such that the discharge side 108 of the piping infrastructure 106 penetrates the pit liner 120 through an outlet conduit 124 defined between the inner surface 127 and the outer surface 128 of the pit liner 120.

As shown in FIG. 1, the curb stop 110 can be installed below-grade on the distribution side 107 of the piping infrastructure 106 external to the pit liner 120. The curb stop 110 can comprise a valve 111, an actuator 112, and an actuator stem 113 housed within a curb stop actuator sleeve 114. The actuator sleeve 114 extends from an opening 116, which can be flush with the surface grade to the below-grade actuator 112 atop the valve 111 and can enable access to operate the below-grade valve. The valve 111 can be closed to isolate the distribution side 107 of the piping infrastructure 106 from the pit inlet connector 102A. The curb stop 110 comprises a lid 117 which can cover the actuator sleeve opening 116 to prevent dirt, debris, or liquids from accumulating in the actuator sleeve 114. The actuator sleeve 114 can be connected to the pit liner outer surface 128 with a bracket 115 which braces the actuator sleeve 114. In some aspects the curb stop can be installed in the pit interior. In some aspects, the curb stop can be installed on the discharge side of the piping infrastructure. In some aspects, a curb stop can be installed on both the discharge and the distribution side of the piping infrastructure, allowing the pit liner to be isolated from the piping infrastructure on both sides. In some aspects, the pit assembly does not comprise a curb stop.

The removable cartridge 140 of FIG. 1 can comprise a chassis 150, a piping system 170, a cartridge inlet connector 142A, an inlet locking mechanism 144A, a cartridge outlet connector 142B, and an outlet locking mechanism 144B. The chassis 150 can comprise several vertical supports 159A-F (referred to herein generally as vertical supports 159) with each defining an upper end 161A-F and a lower end 162A-F opposite from the upper end 161A-F (upper ends 161A,F and lower ends 162A,F shown in FIG. 1, referred to herein generally as upper ends 161 and lower ends 162). The chassis can further comprise an upper platform 151 mounted to the vertical supports 159 proximate to the upper ends 161 of each of the vertical supports and a lower platform 155 mounted to the vertical supports proximate the lower ends 162 of each. The upper platform 151 and lower platform 155 can be substantially normal to the vertical supports 159. The upper platform 151 defines an upper platform top surface 152 and an upper platform bottom surface 153 substantially parallel to and opposite of each other. The lower platform 155 defines a lower platform top surface 156 and a lower platform bottom surface 157 substantially parallel to and opposite of each other. The upper platform 151 and lower platform 155 are positioned such that the upper platform bottom surface 153 faces and is substantially parallel to the lower platform top surface 156.

The upper platform 151 can define a plurality of upper support notches 154A-B (shown in FIG. 3 and referred to herein generally as upper support notches 154), which engage and support the piping system 170. The piping system 170 can comprise a plurality of pipe fittings 175A-D (pipe fitting 175C shown in FIG. 3 and pipe fittings 175A-D referred to herein generally as pipe fittings 175) which each define a lip 176A-D (lip 176C shown in FIG. 3 and lips 176A-D referred to herein generally as lips 176). In some aspects, the piping system 170 defines a rigid U-shaped portion 178 which extends through the upper platform 151 through the upper supports notches 154. The upper support notches 154 can support the piping system 170 through interference between the lips 176A,B of the respective pipe fittings 175A,B and a portion of the upper platform top surface 152 defining an edge of the upper support notches 154. The lower platform 155 can define a plurality of lower support notches 158A-B (lower support notch 158B shown in FIG. 3 and lower support notches 158A-B referred to herein generally as lower support notches 158) which can engage and support the piping system 170 proximate the cartridge inlet connector 142A and the cartridge outlet connector 142B. In some aspects, the piping system 170 penetrates the lower platform 155 through the lower support notches 158 positioning the cartridge inlet connector 142A and cartridge outlet connector 142B below the lower platform bottom surface 157. The lower support notches 158 can support the piping system 170 through interference between the lips 176C,D of the pipe fittings 175C,D positioned above the lower platform 155 and a portion of the lower platform top surface 156 defining the edge of the lower support notches 158.

In some aspects, the vertical support members 159 can extend downwards below the lower platform and define feet 160 A-F (foot 160B shown in FIG. 3, foot 160E shown in FIG. 6, and feet 160 A-F referred to herein generally as feet 160) for supporting the removable cartridge 140. Each foot 160 can define a bottom surface 461A-F (461A,C,D,E,F shown in FIG. 4, bottom surfaces 461A-F referred to herein generally as bottom surfaces 461) which can be disposed in a plane substantially parallel to the upper platform 151 and lower platform 155 which defines a lowest extremity for the removable cartridge 140. When the removable cartridge 140 is placed in a vertical orientation with the feet 160 on a flat surface, the feet 160 are configured to prevent contact between the flat surface and any other portion of the removable cartridge 140.

The piping system 170 of the removable cartridge 140 of FIG. 1 is connected in fluid communication between the cartridge inlet connector 142A and the cartridge outlet connector 142B such that with any valves and equipment in the open position, a fluid can flow through the cartridge inlet connector, pass through the piping system, and exit the cartridge outlet connector. In the aspect shown in FIG. 1, the piping system 170 is configured as a flushing device and comprises a dual-check backflow preventer 171, a vent 177, a solenoid valve 173, and a dechlorinator 172 joined in fluid communication by piping and the pipe fittings 175. The piping and the pipe fittings 175 can be any material, including but not limited to brass or PVC. The solenoid valve 173 can be operated by a programmable controller 174 mounted to the chassis 150. In some aspects, the programmable controller 174 can be mounted to the top surface 152 of the upper platform 151. In some aspects, the solenoid valve 173 can be remotely controlled by a wired or wireless connection. In some aspects, the piping system can comprise different equipment including but not limited to pumps, compressors, filters, meters, sensors, regulators, injection quills, and control valves.

In the aspect shown in FIG. 1, the dual-check backflow preventer 171, the solenoid valve 173, and the dechlorinator 172 are positioned in a portion of the piping system 170 disposed between the upper platform 151 and the lower platform 155. The vent 177 is located on the rigid U-shaped portion 178 of the piping system 170 positioned above the upper platform 151. The dual-check backflow preventer 171 ensures that the fluid can only flow in a desired direction from the cartridge inlet connector 142A thru the piping system 170 to the cartridge outlet connector 142B. In the aspect of FIG. 1, the fluid flows upward into the piping system 170 from the distribution side 107 of the piping infrastructure 106 through the cartridge inlet connector 142A. The fluid then passes through the dual-check backflow preventer 171 and into the rigid U-shaped portion 178 of the piping system 170. After passing through the rigid U-shaped portion 178, the fluid then passes downwards through the solenoid valve 173 to the dechlorinator 172. Once passing through the dechlorinator 172, the fluid then exits the piping system 170 through the cartridge outlet connector 142B, passing into the discharge side 107 of the piping infrastructure 106. FIG. 1 shows only one possible aspect of the removable cartridge 140 and other aspects of the removable cartridge 140 can present different equipment, different orientations of the equipment, or a different flow path through the equipment.

In one aspect, as shown in FIG. 1, the pit inlet connector 102A and the pit outlet connector 102B can be male cam lock couplings, and the cartridge inlet connector 142A and the cartridge outlet connectors 142B can be female cam lock couplings. The cartridge inlet connector 142A can further comprise the inlet locking mechanism 144A, and the cartridge outlet connector 142B can further comprise the outlet locking mechanism 144B, each attached to the respective cartridge connector. Each locking mechanism can comprise a pair of camming levers 145A-D (camming lever 145B shown in FIG. 5 and camming lever 145C shown in FIG. 3 and referred to herein generally as camming levers 145). The camming levers 145A,B of the inlet locking mechanism 144A can be connected to an inlet locking mechanism actuator 146A, and the camming levers 145 C,D of the outlet locking mechanism 144B can be connected to an outlet locking mechanism actuator 146B (referred to herein generally as locking mechanism actuators 146). In some aspects, each mechanism actuator 146 can be a handle assembly comprising a pair of rods 147A-D (rod 147B shown in FIG. 3, rod 147C shown in FIG. 3, and rods 147A-D herein generally referred to as rods 147), each rod 147 comprising a lower end 747 (shown in FIG. 7) connected to a single camming lever 145 of the pair of camming levers 145 for the respective locking mechanisms 144A,B. Each rod 147A-D comprises an upper end 746 (shown in FIG. 7) that can connect to a handle assembly 149A,B. The orientation of the actuators 146A,B can position the handle assemblies149A,B above the chassis 150 to allow access to the handles from the pit opening 122 when the removable cartridge 140 is positioned within the pit liner 120 in an installed position as shown in FIG. 1.

In the installed position, the removable cartridge 140 is positioned within the pit interior 125 with the pit inlet connector 102A inserted into the cartridge inlet connector 142A and the pit outlet connector 102B inserted into the cartridge outlet connector 142B, thereby operably coupling the respective pit connector and cartridge connector together in fluid communication. The inlet locking mechanism 144A and the outlet locking mechanism 144B are both in the locked positions which secures the respective pit connectors 102 to the respective cartridge connectors 142 so that the pit connectors 102 and cartridge connectors 142 cannot be uncoupled without unlocking the respective locking mechanisms 144.

Figure 2:
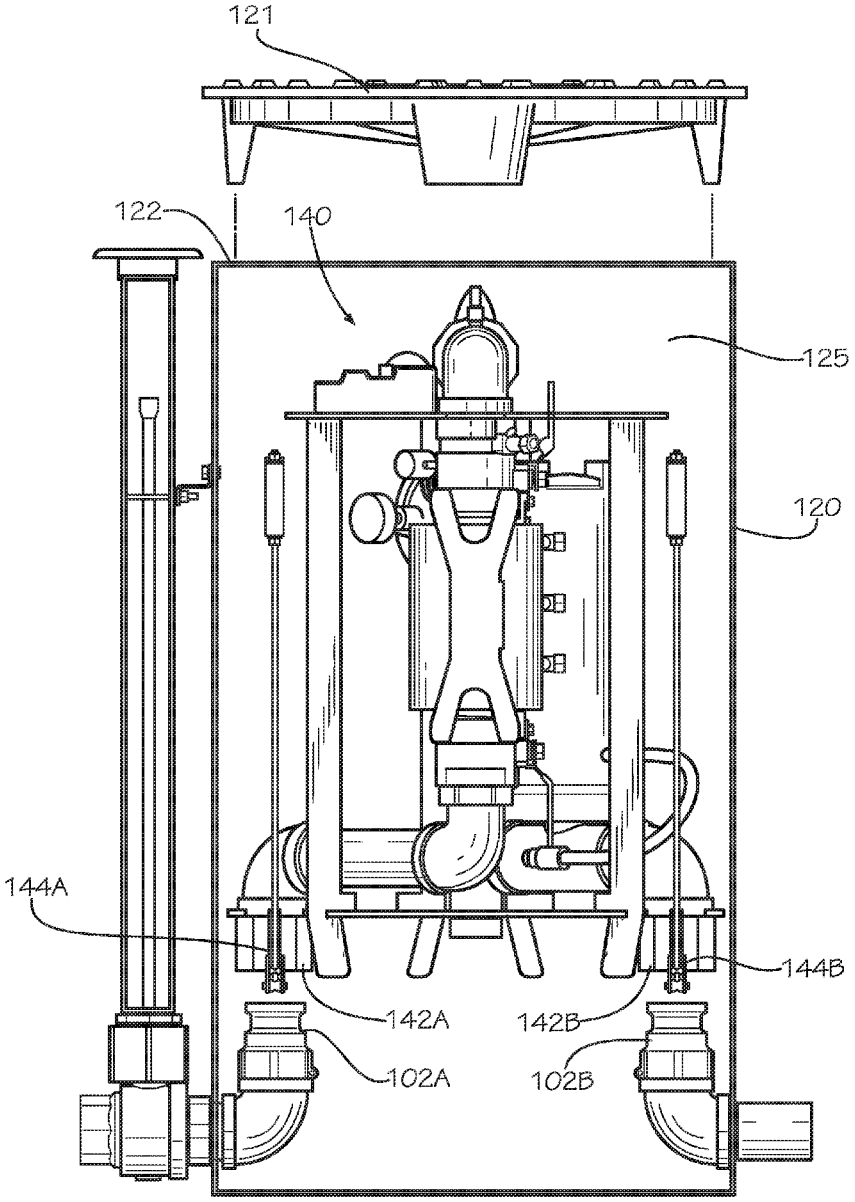
FIG. 2 is a side view of the pit assembly of FIG. 1 with the removable cartridge in the pit liner and disconnected from the pit inlet and the pit outlet.

FIG. 2 shows the pit assembly of FIG. 1 with the removable cartridge 140 still positioned within the pit interior 125 but with the cartridge inlet connector 142A and cartridge outlet connector 142B disconnected from the pit inlet connector 102A and the pit outlet connector 102B, respectively. The inlet locking mechanism 144A and the outlet locking mechanism 144B are in the unlocked positions. The lid 121 is also shown removed, exposing the pit opening 122 and allowing for removal of the removable cartridge 140 from the pit liner 120. In some aspects, the removable cartridge 140 can be removed from the pit liner 120 by pulling upward on the handle assemblies 149. In some aspects, an additional fixed handle can be mounted to the removable cartridge 140 to facilitate removal of the removable cartridge 140 from the pit liner 120. In some aspects, the removable cartridge 140 can be removed from the pit liner 120 by pulling upward on the upper platform 151 or other elements of the chassis 150.

Figure 3:
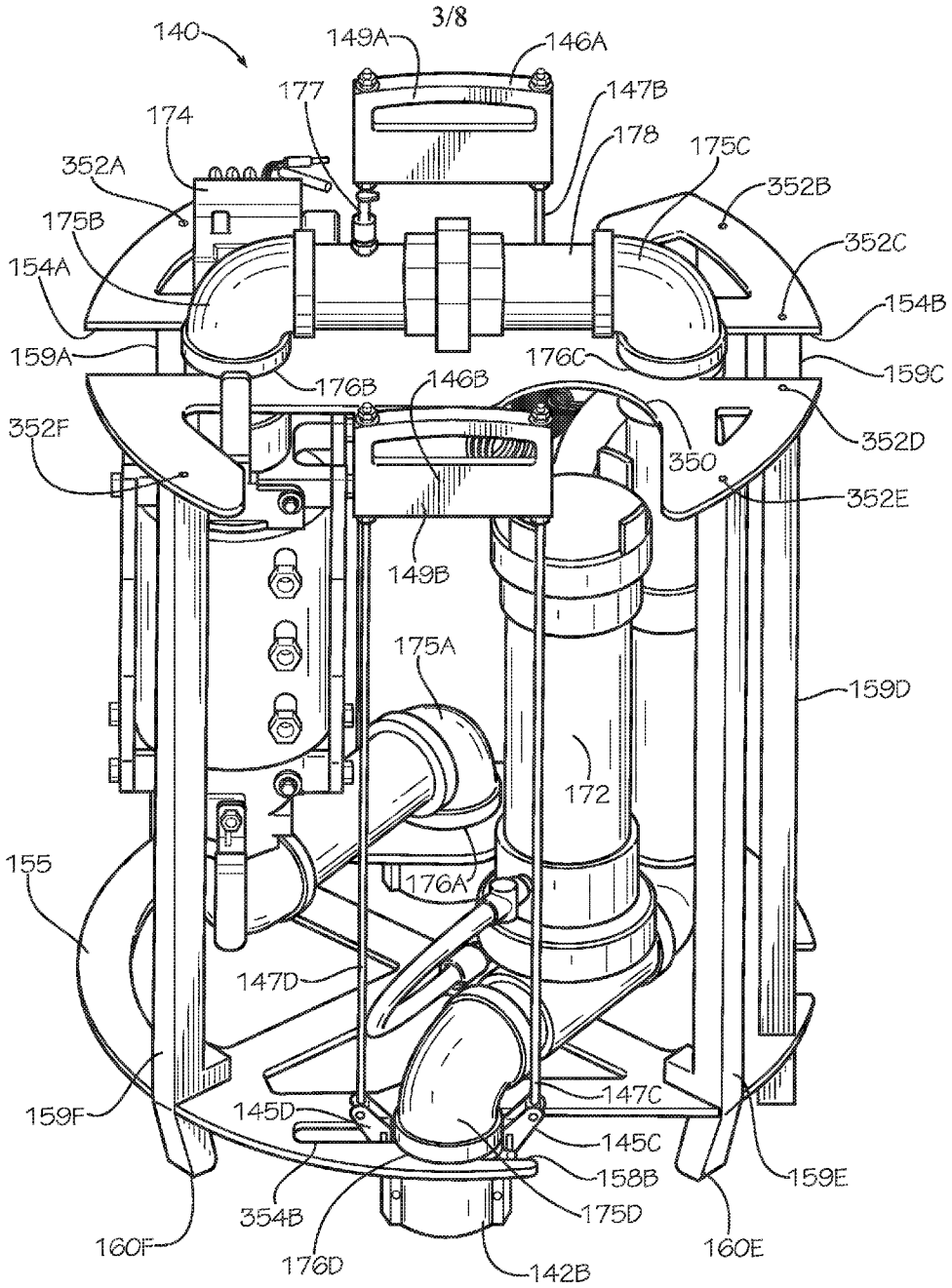
FIG. 3 is downward perspective view of the removable cartridge of FIG. 1 further showing a cartridge outlet connector, an outlet locking mechanism, and a handle actuator.

FIG. 3 shows a downward perspective of the removable cartridge 140 of FIG. 1 facing the cartridge outlet connector 142B. In this aspect, the upper platform 151 is shown attached to the upper ends 161 of the vertical supports 159 with fasteners 352A-F. The fasteners 352 can be screws, nuts, rivets, bolts, or equivalents. In some aspects, the vertical supports 159 can be attached to the upper platform 151 without fasteners 352, such as by welding or with adhesives. In some aspects, the upper ends 161 of the vertical supports 159 can comprise an integral threaded extension which can engage the upper platform 151 directly or with nuts. The vertical supports 159 can also be formed integral to the upper platform 151. The upper platform 151 can additionally define an access cutout which can provide additional access to the elements of the piping system 170 without requiring the removal of the removable cartridge 140 from the pit liner 120. As shown in this aspect, a dechlorinator access cutout 350 is positioned above the dechlorinator 172 which can allow for maintenance such as replacement of dechlorination tabs used in operation of the dechlorinator 172. FIG. 3 provides additional perspective of the upper support notches 154 and lower support notches 158 of the respective upper platform 151 and lower platform 155 engaging the piping system 170 below the pipe fittings 175 to provide support for the piping system. The lower platform 155 can also define a pair of locking mechanism clearance notches 354A,B (locking mechanism clearance notch 354A shown in FIG. 5), which can provide clearance for the camming levers 145A-D of the locking mechanisms 144A,B, allowing the camming levers 145A-D and the respective actuators 146A,B to move about and between the locked position as shown and the unlocked position.

Figure 4:
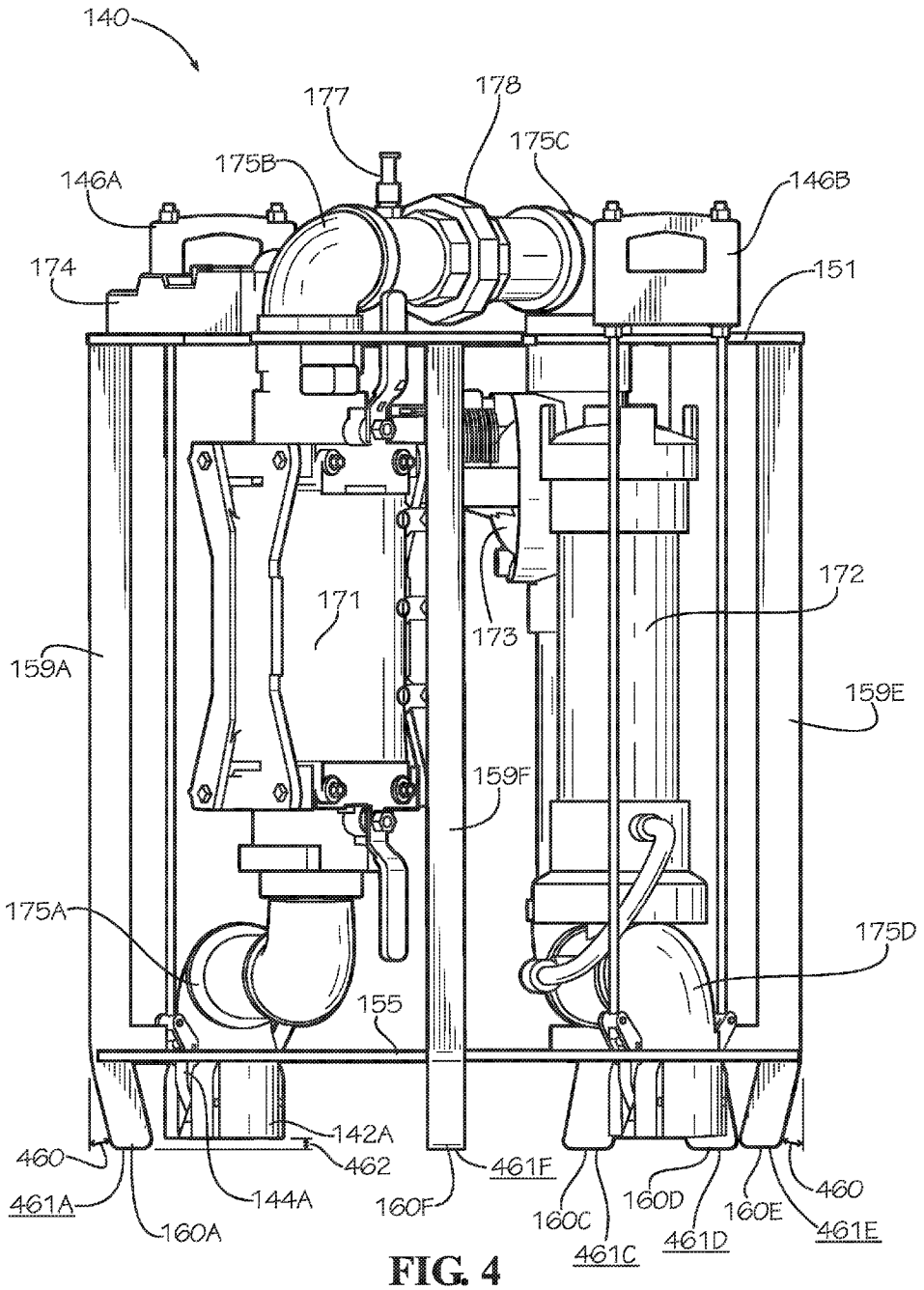
FIG. 4 is a side view of the removable cartridge of FIG. 1 showing a cartridge inlet, a cartridge outlet, a piping system, an inlet locking mechanism, and the outlet locking mechanism shown in FIG. 3.

FIG. 4 shows a side view of the removable cartridge 140 of FIG. 1. In some aspects, the feet 160A,B,E,F can extend inwards at an angle 460 from the vertical axis as they extend downwards from the lower platform 155. An inward angling of the feet 160A,B,E,F can aid in insertion of the removable cartridge 140 by guiding it into the pit opening 122. As previously described, this aspect shows the feet 160 extending downwards below the cartridge inlet connector 142A and cartridge outlet connector 142B such that the feet can prevent contact of the piping system 170 with the ground if the removable cartridge 140 is placed on a flat surface in a vertical orientation. Specifically, contact between the bottom of the cartridge connectors 142 and the ground can be prevented by maintaining a vertical gap 462 between a bottom surface of the cartridge connectors 142 and the bottom surface 461 of the feet 160. Preventing contact between the ground and the cartridge connectors 142A,B can be desirable in order to prevent dirt and debris from entering the connectors which can, for instance, interfere with the sealing of the connectors.

Figure 5:
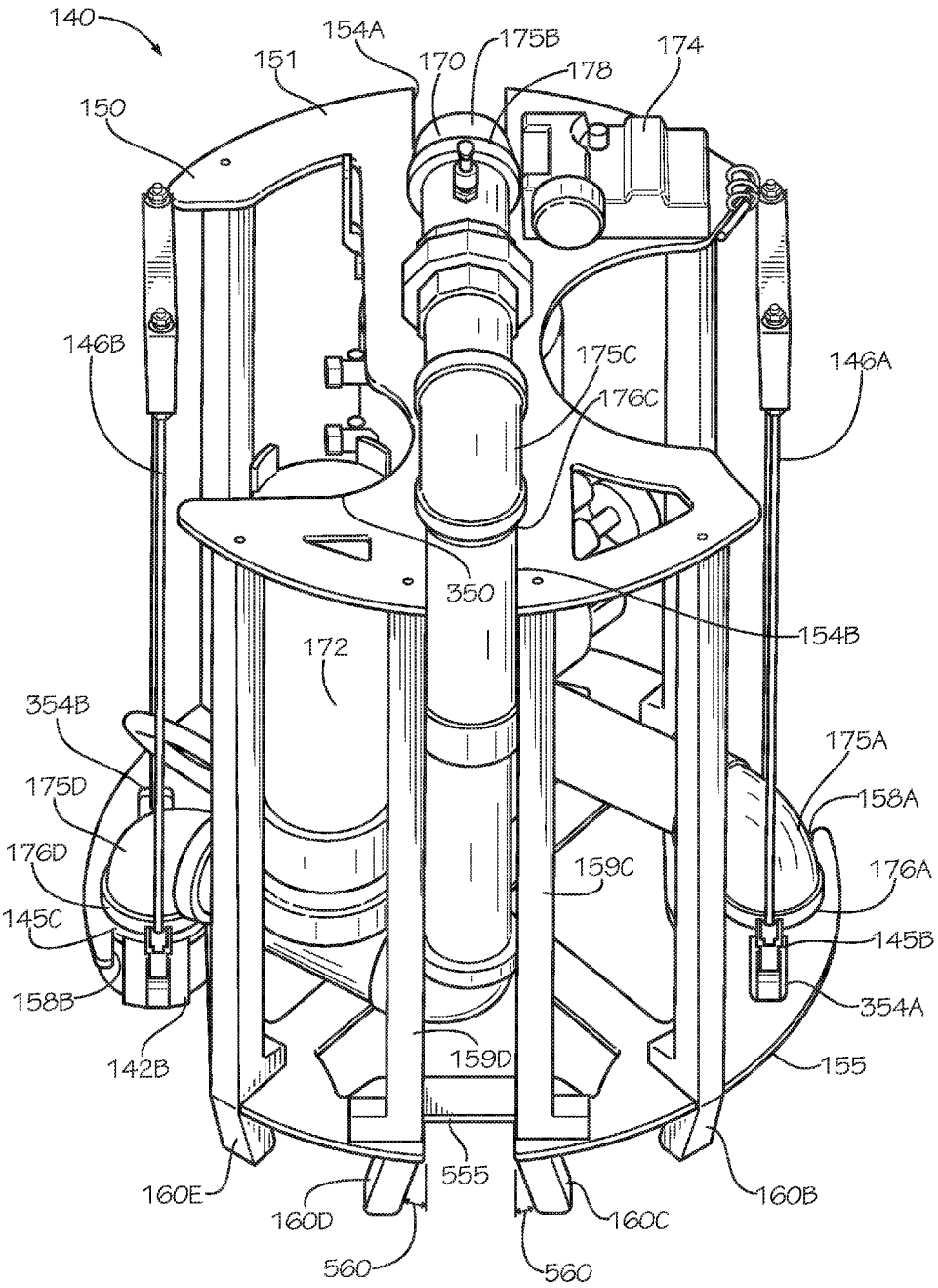
FIG. 5 is a downward perspective view of the removable cartridge of FIG. 1 centered on two guide rail notches defined by an upper platform and a lower platform.
Figure 6:
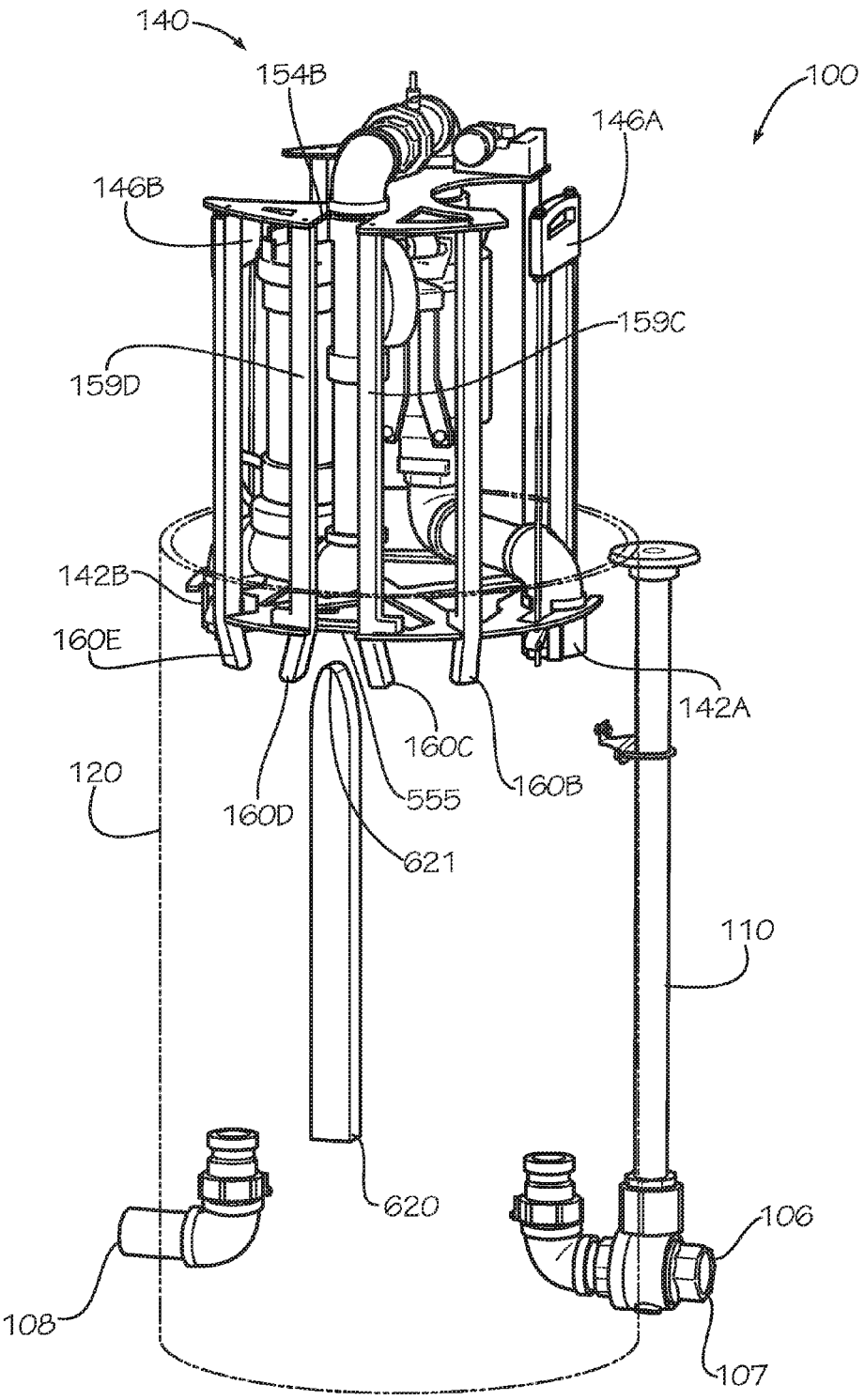
FIG. 6 is a cutaway side perspective view of the pit assembly of FIG. 1 showing the guide rail notches of the removable cartridge positioned to engage a guide rail of the pit liner.

FIG. 5 shows another downward perspective of the removable cartridge 140 of FIG. 1. As shown in this aspect, lower platform 155 can define an alignment notch 555. In this aspect, each of the feet 160C,D extend downward from the lower platform 155 and outward from the alignment notch 555 at an angle 560 from the vertical axis. The alignment notch 555 and the angled feet 160C,D can be configured to engage a vertically-oriented guide rail 620 (shown in FIG. 6) disposed on the inner surface 127 of the pit liner 120 in the pit interior 125. The upper support notch 154B can additionally function as an alignment notch for the guide rail 620. The guide rail 620 and the alignment notch 555 can control the orientation of the cartridge within the pit liner 120 and can aid in guiding the female cartridge connectors 142A,B onto the respective male pit connectors 102A,B. As shown in FIG. 6, the vertical supports 159C,D can also function to engage the guide rail 620. As the removable cartridge 140 is inserted into the pit liner 120, the feet 160C,D and the vertical supports 159C,D adjacent to the lower platform alignment notch 555 can aid in guiding the removable cartridge 140 until the removable cartridge 140 has been inserted far enough for the upper support notch 154B to engage the guide rail 620. The upper end 621 of the guide rail 620 can also be curved, chamfered, or radiused in various aspects which can provide additional aid in alignment between the removable cartridge 140 and the pit liner 120. In some aspects, the pit liner can comprise multiple guide rails 620 and the removable cartridge 140 can define multiple alignment notches 555 for engaging the guide rails 620. Optionally, in some aspects the pit liner 120 does not comprise a guide rail 620. In some aspects, the cartridge connectors 142 can comprise stabbing guides including but not limited to conical collars or angled surfaces which can aid in guiding the pit connectors 102 into the respective cartridge connectors 142 when inserting the removable cartridge 140 into the pit liner 120.

Figure 7C:
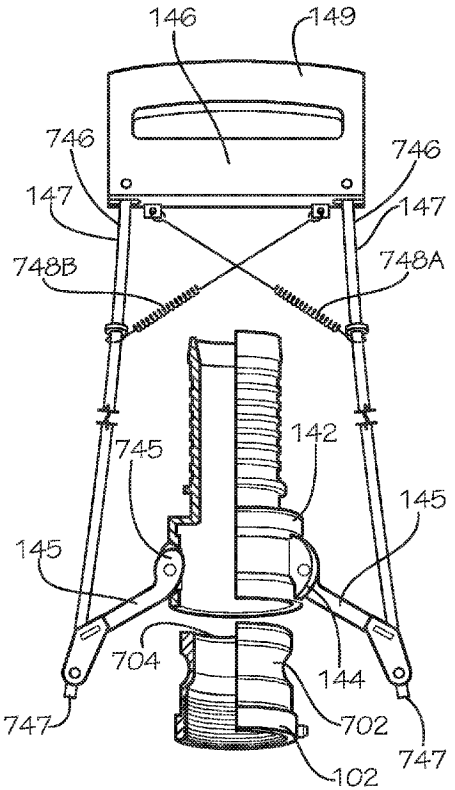
FIGS. 7A, 7B, and 7C show perspective views of one aspect of the locking mechanism actuator operating a locking mechanism.
Figure 7B:
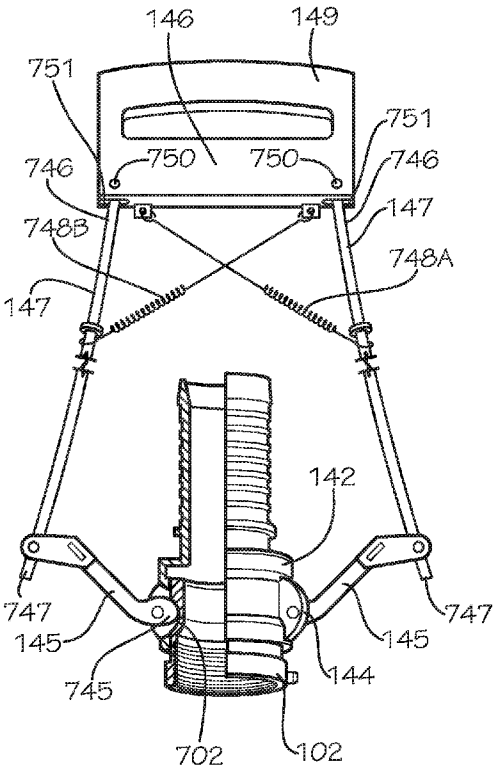
Figure 7A:
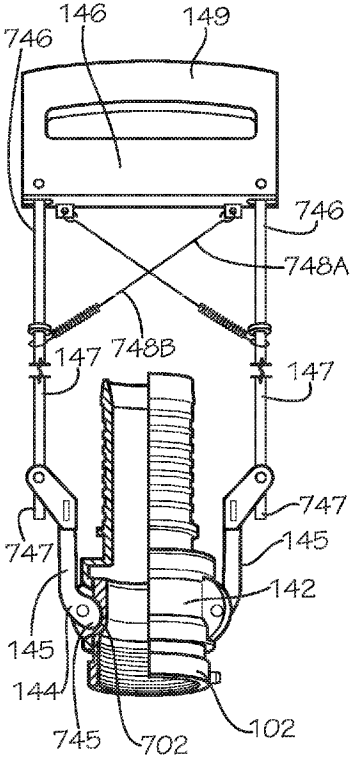
Figure 8C:
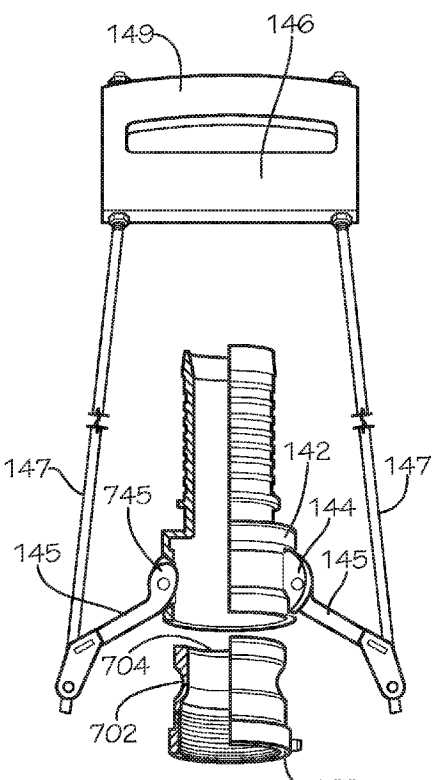
FIGS. 8A, 8B, and 8C show perspective views of another aspect of the locking mechanism actuator operating a locking mechanism.
Figure 8B:
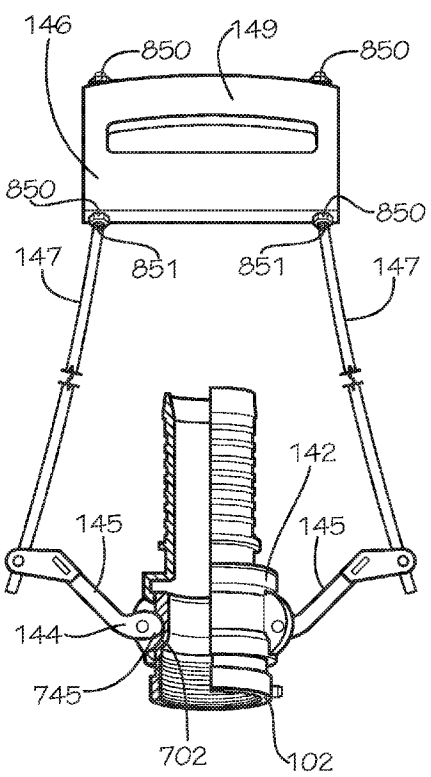
Figure 8A:
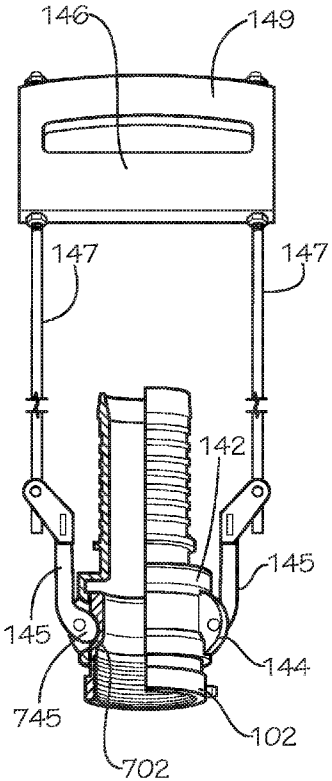

FIGS. 7A-C and 8A-C show two optional aspects of the locking mechanism actuators 146A,B and demonstrate the function of one optional aspect of the cartridge connectors 142A,B, the pit connectors 102A,B, and the locking mechanisms 144A,B. In some aspects as shown in FIGS. 7A-C and 8A-C, the inlet cartridge connector 142A and the outlet cartridge connector 142B can be female cam lock connectors and the respective pit inlet connector 102A and pit outlet connector 102B can be male cam lock connectors. In some aspects, the locking mechanisms 144A,B each can comprise a pair of the camming levers 145A-D. As shown in the cutaway view portion of FIGS. 7A-C and 8A-C, the pit connectors 102 define a circumferential groove 702 proximate an opening 704 of the pit connector102. The two camming levers 145 of the cartridge connectors 142 each define a rounded lobe 745 (only one rounded lobe 745 shown in the cutaway view portion of FIGS. 7A-C and 8A-C). With the pit connector 102 inserted into the cartridge connector 142, the rounded lobe 745 of each of the camming levers 145 can be configured to engage the groove 702 of the pit connector 102 when the camming levers 145 are moved to the locked position of the locking mechanism 144 as shown in FIGS. 7A and 8A. With the rounded lobes 745 of the camming levers 145 engaging the groove 702 of the pit connector 102, the pit connector is secured to the cartridge connector 142 and cannot be withdrawn without rotating the camming levers 145 to the unlocked position of the locking mechanism 144 as shown in FIGS. 7C and 8C. In the unlocked position, the camming levers 145 are be rotated so that the rounded lobes 745 disengage the groove 702 of the pit connector 102 which allows pit connector to be withdrawn from the cartridge connector 142. In some embodiments, the pit inlet connector 102A and pit outlet connector 102B can be female cam lock connectors, and the cartridge inlet connector 142A and cartridge outlet connector 142B can be male cam lock connectors.

FIGS. 7A-C show an embodiment of the handle assembly 149 of the locking mechanism actuator 146 that comprises one or more springs 748A,B (referred to herein generally as springs 748). As shown in FIG. 7B, the upper ends 746 of the rods 147 each fit into one of a pair of slots 751 defined by the handle assembly 149 and are each pinned in place by one of a pair of pins 750 which allow the rods 147 to pivot relative to the handle assembly 149. The slots 751 provide clearance for the rods 147 when pivoting outwards. The springs 748 can exert an inward force on the rods 147 which biases against the selectable movement of the locking mechanism 144 about and between the locked position (FIG. 7A) and the unlocked position (FIG. 7C). FIG. 7B shows the locking mechanism in transition between these two positions. As shown, the lower ends 747 of the rods 147 are deflected outward away from one another in this state. The springs 748 resist the outward motion of the lower ends 747 of the rods 147. The springs 748 produce the biasing force which acts to maintain the locking mechanism 144 in either the locked position or the unlocked position while resisting movement between these positions.

FIGS. 8A-C demonstrate a similar effect in an aspect of the locking mechanism actuator 146 relying on a cantilevered force of the rods 147 to bias the locking mechanism 144 against movement about and between the locked and unlocked positions. As shown in FIG. 8B, the rods 147 extend through bores in the handle assembly 149 and are secured in place with fasteners 850. The fasteners 850, which are nuts in the current aspect, engage a threaded portion 851 of each rod 147 on the top and bottom of the handle assembly 149. This configuration prevents the rods from pivoting relative to the handle assembly 149. As locking mechanism 144 is in transition (FIG. 8B) about and between the locked position (FIG. 8A) and the unlocked position (FIG. 8C), the bending rods 147 are deflected outwards which produces the cantilevered force biasing against the selectable movement of the locking mechanism 144. In the aspects shown in FIGS. 7A-C and 8A-C, the handle assembly 149 of the locking mechanism actuator 146 is pulled upward to engage the locking mechanism 144 in the locked position. Pushing the handle assembly 149 downwards moves the locking mechanism 144 to the unlocked position. In some aspects, it can be desirable to configure the locking mechanism actuator 146 to unlock the locking mechanism 144 when pulling upwards on the locking mechanism actuator 146 and to lock the locking mechanism 144 when pushing downwards on the locking mechanism actuator 146. In some aspects, a single locking mechanism actuator 146 can operate both the inlet and outlet locking mechanisms 144A,B. In some aspects, the locking mechanism actuator 146 can be operated by a twisting or rotational motion.

In some aspects, the pit assembly 100 comprising the removable cartridge 140 and the pit liner 120 can provide a method for connecting the piping system 170 in fluid communication to the piping infrastructure 106. Prior to inserting or removing the removable cartridge 140, it can be desirable to depressurize or isolate the piping infrastructure 106 from the pit connector 102 by closing a valve such as a curb stop 110. The removable cartridge 140 can be inserted into the pit liner 120, thereby positioning the piping system 170 within the pit liner 120. The insertion of the removable cartridge 140 into the pit liner 120 can be aided by the feet angles 460 of the feet 160A,B,E,F. The alignment of the removable cartridge 140 with the pit liner 120 can be aided by the guide angles 560 of the feet 160C,D and the alignment notch 555 engaging the rounded upper end 621 of the guide rail 620. The cartridge connector 142 of the piping system 170 can then be operably coupled to the pit connector 102 in fluid communication with the piping infrastructure 106. In some aspects, the cartridge connector 142 can be operably coupled to the pit connector 102 by stabbing the pit connector 102 into the cartridge connector 142 as the removable cartridge 140 is inserted into the pit liner 120. Once the cartridge connector 142 is operably coupled to the pit connector 102, the locking mechanism 144 can be engaged to secure the pit connector 102 to the cartridge connector 142. In some aspects, the locking mechanism 144 can be engaged by pulling upwards on the handle assembly 149 of the locking mechanism actuator 146. Pulling upwards on the handle assembly 149 can rotate the camming levers 145 so that the rounded lobes 745 of the camming levers 145 can engage the groove 702 of the pit connector 102. The locking mechanism 144 can also be disengaged which allows the cartridge connector 142to be uncoupled from the pit connector 102, and the removable cartridge 140 can be removed from the pit liner 120 in order to disconnect the piping system 170 from the piping infrastructure 106. In some aspects, it can be desirable to close a curb stop 110 on the distribution side 107, discharge side 108, or both prior to unlocking the inlet and outlet locking mechanisms 144 to isolate the removable cartridge 140 from pressure and prevent the uncontrolled discharge of fluid upon removing the removable cartridge 140. In some aspects, the pit assembly 100 can comprise a safety interlock that prevents the removal of the removable cartridge 140 prior to closing the curb stop 110 or equivalent shutoff valve.

The pit assembly 100 comprising a removable cartridge 140 and a pit liner 120 can fill many desirable roles. In some aspects, the removable cartridge 140 can be configured as a flushing device which can be used to prevent stagnation in a fluid system, eliminate contaminants in a system, to prevent freezing in a system, or other purposes. In various aspects, the removable cartridge 140 could be configured for purposes such as managing the pressure of a piping infrastructure 106 by installing equipment including but not limited to a pump, compressor, pressure safety valve, regulator, choke, or pressure-control valve. In various aspects, the removable cartridge 140 can be configured for purposes including but not limited to metering a fluid flow, sampling the fluid flow, injecting chemicals such as biocides or corrosion inhibitors, filtering of the fluid, or monitoring with instrumentation such as pH, pressure, or temperature sensors.

The ability to easily install and remove the removable cartridge 140 can also be desirable for the installation of maintenance-intensive equipment, temporary applications, seasonal applications such as equipment that may need to be removed for winterization, or locations with changing functional requirements where modularity can be beneficial. In some aspects, the pit assembly 100 comprises only a single inlet or outlet for applications such as an injection site or discharge site, for instance a filling location. In some aspects, the pit assembly 100 can comprise multiple inlets. In some aspects, the pit assembly 100 can comprise multiple outlets. Such aspects can be desirable for purposes in which the removable cartridge 140 can be configured for blending fluid streams, separation of fluids from a single stream, or as a manifold for routing fluids through multiple piping infrastructures 106 connected to the pit liner 120. In some aspects, the pit assembly 100 could comprise multiple removable cartridges 140 simultaneously installable into a single pit liner 120. The multiple removable cartridges 140 can serve redundant purposes such as to enhance reliability and availability in multiple parallel flow paths or varied purposes such as to function as different modules sequenced in series in a single flow path.

Aspects of the disclosed pit assembly 100 can also be a desirable option for retrofitting piping infrastructures 106 with updated or new equipment for purposes including but not limited to regulatory compliance, upgrading aging or outdated equipment, or to accommodate industrial, commercial, or residential development. Aspects of the pit assembly 100 can also provide an option for updating piping infrastructures 106, especially below-grade piping infrastructures, with wireless "smart" equipment which can require surface access for uninterrupted communication signals. In such aspects, equipment can be installed below-grade while an antenna or similar device can be located proximate the lid 121 or pit opening 122.

In some aspects, the pit and cartridge connectors 102, 142 can be quick-disconnect couplings which can comprise locking mechanisms 144 including but not limited to sliding-sleeves such as ball-locks and pin-locks, twist-sleeves, twist-lock claws, split-ring locks, or bayonet lugs and grooves. In some aspects, the pit and cartridge connectors 102, 142 can be flat-faced couplings. In some aspects, the connectors 102, 142 may exhibit a single shut-off mechanism in which the pit connector 102 or cartridge connector 142 contains a valve that prevents fluid from escaping upon disconnecting the connectors 102, 144. In some aspects, the connectors 102, 142 may exhibit a double shut-off effect in which both the pit connector 102 and cartridge connector 142 contain valves that prevent fluids from escaping upon disconnection. In some aspects, the pit connector 102 and cartridge connector 142 can be a dry-break quick disconnect which closes and seals upon disconnection preventing leakage over time. Such aspects can be desirable when the fluid is toxic, flammable, or otherwise hazardous. Such aspects can also provide an element of safety to allow the removable cartridge 140 to be safely removed without depressurizing or isolating the piping system 170 from the piping infrastructure 106. Such aspects can also be desirable when there is a benefit to preventing the entry of air into the piping infrastructure 106 or maintaining pressure in the piping infrastructure 106.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the present disclosure, nor the claims which follow.

That which is claimed is:

1. A pit assembly comprising:

a pit liner defining an inner surface and an outer surface, the inner surface defining an interior of the pit liner, the inner surface and the outer surface further defining a pit opening proximate to an upper portion of the pit liner;

a pit connector positioned in the interior of the pit liner;

a removable cartridge positionable within the interior of the pit liner, the removable cartridge comprising:

a chassis, a cartridge connector mounted to the chassis and configured to operatively couple in fluid communication to the pit connector, and a piping system in fluid communication with the cartridge connector and mounted to the chassis; and a locking mechanism selectively movable about and between a locked position and an unlocked position, wherein the locked position of the locking mechanism is configured to securely couple the pit connector to the cartridge connector, and wherein the unlocked position of the locking mechanism is configured to release the pit connector from the cartridge connector.

2. The pit assembly of claim 1, further comprising a second pit connector positioned in the interior of the pit liner, wherein the removable cartridge further comprises a second cartridge connector mounted to the chassis and configured to operably couple in fluid communication to the second pit connector, the second cartridge connector in fluid communication with the piping system.

3. The pit assembly of claim 2, further comprising a second locking mechanism selectively movable about and between a second locked position and a second unlocked position, wherein the second locked position of the locking mechanism is configured to securely couple the second pit connector to the second cartridge connector, and wherein the second unlocked position of the second locking mechanism is configured to release the second pit connector from the second cartridge connector.

4. The pit assembly of claim 1, wherein the locking mechanism is a cam lock coupler.

5. The pit assembly of claim 1, wherein the locking mechanism is connected to an actuator configured to selectively move the locking mechanism about and between the locked and unlocked positions.

6. The pit assembly of claim 5, wherein the actuator is a handle assembly accessible from the pit opening, the handle assembly configured to exert a biasing force against selectively moving the locking mechanism about and between the locked and unlocked positions.

7. The pit assembly of claim 6, wherein the handle assembly comprises a handle and a pair of rods, each rod comprising an upper end and a lower end distal from the upper end, the handle connected to the pair of rods proximate to the upper ends of the rods, the lower ends of the pair of rods connected to the locking mechanism, the rods configured to produce the biasing force by cantilevered deflection of the rods.

8. The pit assembly of claim 1, wherein the pit liner further comprises a guide rail mounted on the inner surface of the pit liner and protruding into the interior of the pit liner, and wherein the chassis defines a notch configured to engage the guide rail of the pit liner.

9. The pit assembly of claim 1, wherein the pit connector is a male connector and the cartridge connector is a female end, the pit connector configured to stab into the cartridge connector.

10. A removable cartridge configured for installation in a pit comprising a pit inlet connector and a pit outlet connector comprising:

a chassis;

a cartridge inlet connector configured to operatively couple in fluid communication to the pit inlet connector;

a cartridge outlet connector configured to operatively couple in fluid communication to the pit outlet connector;

an inlet locking mechanism mounted to the cartridge inlet connector and selectively movable about and between a locked position and an unlocked position, the locked position configured to securely couple the cartridge inlet connector to the pit inlet connector, the unlocked position configured to release the cartridge inlet connector from the pit inlet connector;

an outlet locking mechanism mounted to the cartridge outlet connector and selectively movable about and between a locked position and an unlocked position, the locked position configured to securely couple the cartridge outlet connector to the pit outlet connector, the unlocked position configured to release the cartridge outlet connector from the pit outlet connector; and a piping system in fluid communication with the cartridge inlet connector and the cartridge outlet connector and mounted to the chassis.

11. The removable cartridge of claim 10 further comprising a foot extending downward from the chassis, a lower end of the foot below the cartridge inlet connector and the cartridge outlet connector.

12. The removable cartridge of claim 10, wherein the inlet locking mechanism and the outlet locking mechanism are cam lock couplers.

13. The removable cartridge of claim 10 wherein the chassis further comprises an upper platform, a lower platform, and a vertical member, the upper platform defining an upper platform top surface and an upper platform bottom surface, the lower platform defining a lower platform top surface and a lower platform bottom surface, the vertical member defining an upper end and a lower end distal from the upper end, the upper platform connected proximate to the upper end of the vertical member and the lower platform connected proximate to the lower end of the vertical member, the lower platform top surface facing the upper platform bottom surface, the upper platform comprising an upper perimeter defining an upper support notch configured to engage with the piping system, the lower platform comprising a lower perimeter defining a lower support notch engaging one of the cartridge inlet connector and the cartridge outlet connector.

14. The removable cartridge of claim 13 wherein the upper platform further defines an access cutout.

15. The removable cartridge of claim 10, further comprising a handle positioned above the chassis and connected to the inlet locking mechanism, wherein the handle selectively moves the inlet locking mechanism about and between the locked position and the unlocked position.

16. The removable cartridge of claim 15, wherein the handle is connected to the inlet locking mechanism by a linkage configured to bias the inlet locking mechanism against movement about and between the locked and unlocked positions.

17. A method for connecting a piping system in fluid communication to a piping infrastructure, the method comprising:

inserting a removable cartridge into a pit liner, the pit liner comprising a pit connector positioned in a pit interior defined by an inner surface of the pit liner, the pit connector being in fluid communication with the piping infrastructure, the removable cartridge comprising the piping system, a chassis, and a cartridge connector in fluid communication with the piping system, the piping system and the cartridge connector mounted on the chassis;

operably coupling the cartridge connector to the pit connector to place the piping system into fluid communication with the piping infrastructure; and engaging a locking mechanism to secure the pit connector to the cartridge connector.

18. The method of claim 17 wherein the locking mechanism is a cam lock coupler.

19. The method of claim 17 further comprising the steps of:

disengaging the locking mechanism to release the pit connector from the cartridge connector;

uncoupling the cartridge connector from the pit connector; and removing the removable cartridge from the pit liner.

20. The method of claim 17 wherein operably coupling the cartridge connector to the pipe connector comprises stabbing the pit connector into the cartridge connector.

21. The method of claim 17 wherein the piping infrastructure comprises a distribution side in fluid communication with the pit connector and a discharge side in fluid communication with a second pit connector, the second pit connector positioned in the pit interior, wherein the removable cartridge further comprises a second cartridge connector mounted to the chassis, the second cartridge connector in fluid communication with the piping system, the method further comprising:

operably coupling the second cartridge connector to the second pit connector; and engaging a second locking mechanism to secure the second pit connector to the second cartridge connector.

22. The method of claim 17 wherein engaging the locking mechanism comprises pulling a handle coupled to the locking mechanism by a rod.

23. A pit assembly comprising:

a pit liner defining an inner surface and an outer surface, the inner surface defining an interior of the pit liner, the inner surface and the outer surface further defining a pit opening proximate to an upper portion of the pit liner;

a pit piping element positioned in the interior of the pit liner;

a removable cartridge positionable within the interior of the pit liner, the removable cartridge comprising:

a chassis, and a piping system in fluid communication mounted to the chassis, the piping system comprising an inlet; and a means for operably coupling and locking the pit piping element to the inlet of the piping system of the removable cartridge in fluid communication.

* * * * *